United States Patent [19]

Lin

[11] Patent Number: 4,857,134

[45] Date of Patent: Aug. 15, 1989

[54] STRUCTURE OF CARTON SEALING STICKER AND CUTTER

[76] Inventor: Shuh-Chin Lin, No. 5, 35th Lane, 4th Alley, An-Lo Rd., Chung-Ho City, Tapei Hsien, Taiwan

[21] Appl. No.: 129,318

[22] Filed: Dec. 3, 1987

[51] Int. Cl.[4] ..... B32B 31/00

[52] U.S. Cl. ..... 156/385; 156/384; 156/387; 156/486; 156/523; 156/527; 156/577; 156/579

[58] Field of Search ..... 156/385, 523, 387, 579, 156/486, 577, 384, 527; 101/DIG. 19

[56] References Cited

U.S. PATENT DOCUMENTS 3,466,843 9/1969 Mumper ..... 156/486

3,753,839 8/1973 Funke et al. ..... 156/579

*Primary Examiner*—John J. Gallagher

*Attorney, Agent, or Firm*—Browdy and Neimark

[57] ABSTRACT

A carton sealing tape sticker and cutter mainly consisting of an auxiliary roller pivoted between the main roller and the word printing device. The word printing device has the functions of tape direction and guiding. The auxiliary roller not only aids the main roller in pressing the pasted tape flat but also conducts the turning movement when the structure turns from one side of the caton to another side. Then, the main roller continues the turning accordingly to maintain the turning operations smoothly. When the tape is pulled out for use, the tape drives the word roller of the transfer printing device into rotation. The word roller's surface has protruded words or figures, which maintains proper contact with the color printing roller during rotation and also makes the printing material stored in the color printing roller attach on the protruded words or figures and print on the back side (the glue-containing side) of the rotated blank transparent tape which is then immediately pasted on the place the user wishes. In this way, the printed words or figures will never be eliminated and the carton sealing transparent tape performs the functions of advertisement and sealing at the same time.

4 Claims, 3 Drawing Sheets

A-A SECTION

B-B SECTION

STRUCTURE OF CARTON SEALING STICKER AND CUTTER

FIELD OF THE INVENTION

The present invention relates to a new structure for a manual carton-sealing tape sticker and cutter, particularly to the structure that during the process of sealing carton, the back (the glue-containing side) of the used blank transparent tape can be printed with set words and can also turn 90° to continually paste the tape to another side of the carton.

BACKGROUND OF THE INVENTION

Except for heavy products, various finished products delivered by all manufacturing factories are often packed in corrugated cartons. Some of the tapes used to seal these cartons are transparent blank tapes. Regrettably these tapes only allow the gluing action without providing any other functions The conventional carton sealing tape sticker and cutters can only perform straight line sticking, but to seal the carton over its entire surface often requires a 90° turn from the top of the carton to its sides in extension or even to its bottom. This is a very difficult operation because only a main roller is provided. Besides, it is labor and time consuming and an undesirable quality is usually achieved.

OBJECTS OF THE INVENTION

The primary object of the present invention is to solve the defects found in the aforesaid conventional carton-sealing tape stickers and cutters by providing a new structure for the carton-sealing tape sticker and cutter. According to this new structure, an automatic word printing device is installed on the direction-guiding roller to automatically print the set words or figures on the back of the tape which passes through the device. Then this tape is immediately stuck on the opening, so the printed words or figures on the front side of the tape cannot be eliminated and cannot easily be imitated by other people. In this way, the carton-sealing transparent blank tape performs both advertisement and sealing functions.

A further object of this invention lies in that an auxiliary roller is added between the main roller and the word printing device. During turning, this auxiliary roller can act mutually with the main roller to easily turn from one side to another side of the carton. Thereby it saves packing time and also enhances the quality.

SUMMARY OF THE INVENTION

The structure of carton-sealing tape sticker and cutter of the present invention mainly comprises the body, a tape sleeve ring, a main roller, an auxiliary roller, a word printing device and a cut-off device. An auxiliary roller with a diameter smaller than the main roller diameter is installed between the main roller and the word printing device to make the tape turn easily and continually seal and stick to another side of the carton while sealing the carton. When the transparent blank tape is pulled out for use and passes through the word printing device, the word printing device can automatically print the engraved words or figures of the word roller on the back (the glue-containing side) of the tape. The word roller is installed at position of the direction-guiding roller shaft of the conventional tape sticker and cutter. A color printing roller device is installed between the two side boards of the body at the position adjacent to the direction-guiding roller shaft device in contact with the word roller. When using the tape, the output tape drives the word roller and the color printing roller in rotation at the same time. Meanwhile, the printing material of the color printing roller attaches to the protruded words of the word roller. Immediately, the words are printed on the back of the blank transparent tape and the tape is stuck and seals the opening of the carton.

SPECIFIC DESCRIPTION OF THE PREFERRED EMBODIMENT

Figure 1:
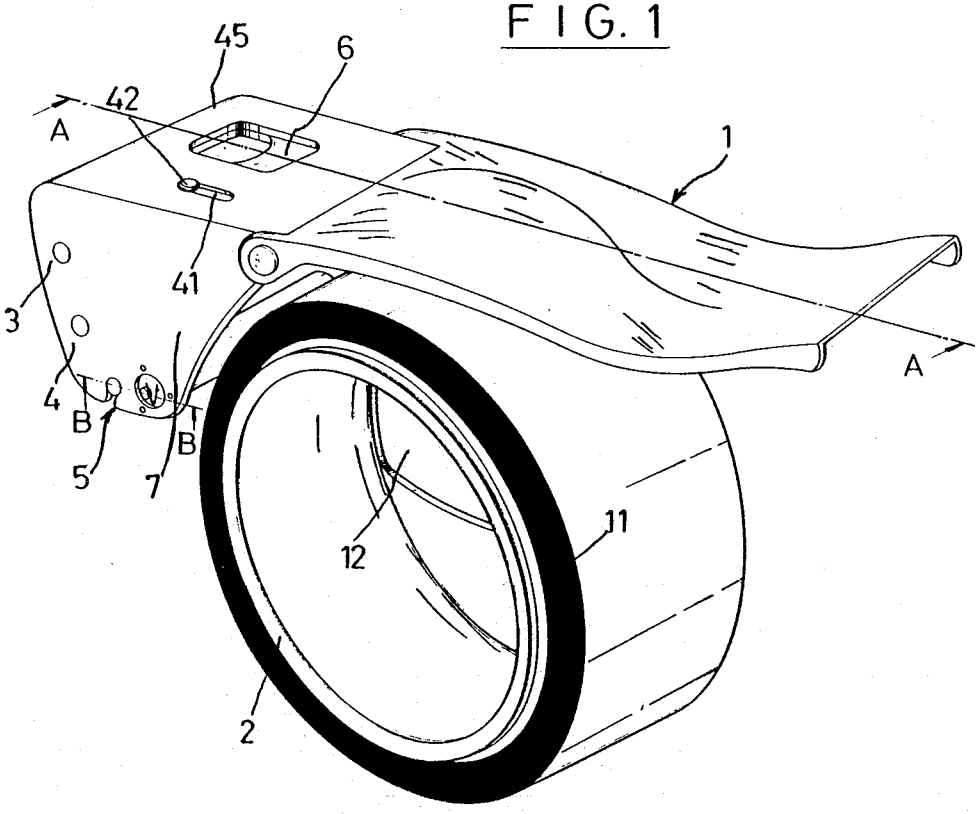
FIG. 1 is a perspective view of the appearance of the carton-sealing tape sticker and cutter of the present invention, showing the sleeve-on tape roller in a complete and applicable state.
Figure 2:
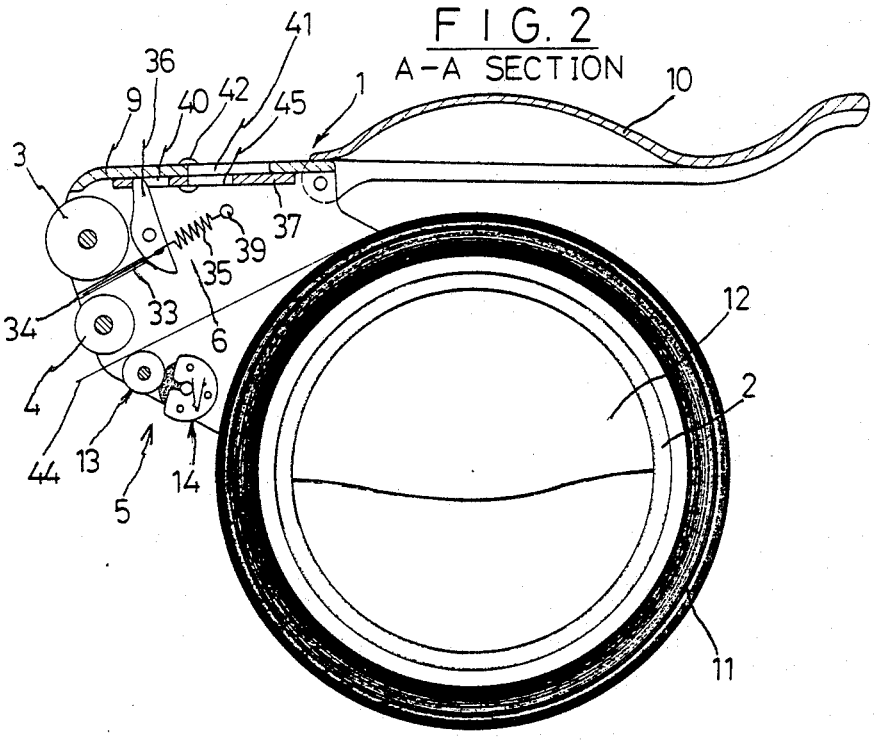
FIG. 2 is a cross-sectional view, taken along line A—A of FIG. 1 when the tape roller is removed.

As shown in FIGS. 1 and 2, the present invention is composed of body 1, tape sleeve ring 2, main roller 3, auxiliary roller 4, word printing device 5 and cut-off device 6. Body 1 has two side boards, the left side board 7 being short and only provided on the front of body 1, and the right side board 8 being long. The front of right side board 8 and the left side board 7 are both pivoted on the main roller 3, auxiliary roller 4, word printing device 5 and also coupled with the blade 33 of the cut-off device 6. The rear part of the left side board 8 is singly joined to the tape sleeve ring 2. The front of the top plane of grip handle 10 has a bulging form to mesh the concave depression in the user's palm when he grasps the handle and makes his palm closely contact the handle. The tape sleeve ring 2 has a hollow cylindrical shape whose outside diameter is adapted to the inner diameter of the tape sleeve ring 11, and, as described above, is singly joined to the rear part of the right side board 8 to sleeve on the type roll. Besides, a semi-circular hole 12 is shown on the right side board 8 covered by the tape sleeve ring 2. When the user grips the grip handle 10, his middle finger, ring finger and small finger can be inserted into semi-circular hole 12 for easy holding and operation. Main roller 3 and auxiliary roller 4 are both of cylindrical forms, and their pivot point can be a movable shaft or a fixed shaft. The outside diameter of main roller 3, however, is bigger than that of auxiliary roller 4. Main roller 3 rolls and presses the tape to closely contact the adhesive face; auxiliary roller 4 aids the main roller 3 to turn the adhesive face 90° for continually pasting the tape on contiguous sides of the carton.

Figure 3:
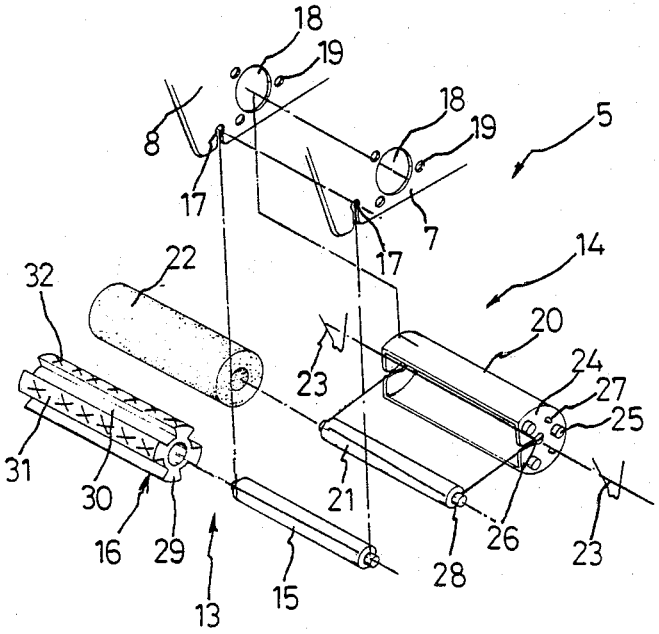
FIG. 3 is an exploded perspective view of the structure of the word printing device of the present invention.
Figure 4:
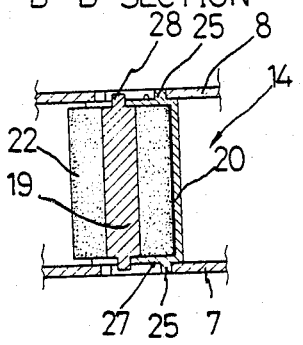
FIG. 4 is a cross-sectional view, taken along line B—B of FIG. 1 of the color printing roller.

As shown in FIGS. 2, 3 and 4, the word printing device 5 of the present invention is also pivoted between the two side boards 7 and 8, and is positioned behind the auxiliary roller 4. It has the function of guiding the tape direction and automatically printing words on the back of the tape. The printing device 5 is composed of the word roller device 13 and the color printing roller device 14. The word roller device 13 is sleeved wherein the word roller 16 is sleeved on the pivot rod 15, and the completed roller device 13 is inserted and positioned into the slot holes 17 on the two side boards 7 and 8 of the body 1. A through hole 18 is respectively installed on device 13, whose neighboring perimeter is provided with three or several through catch holes 19 to join the color printing roller device 14 which is composed of cabinet 20, pivot rod 21, color printing roller 22 and tension spring 23. Cabinet 20 has an arc shape and each of its two ends, respectively, has an end wall 24. A catch pin 25 is provided on the outer rim of the end wall 24 and corresponds to the catch holes 19 on the two side boards 7 and 8 for their mutual mesh to make the color printing roller device 14 fixed at a position adjacent to the word roller device 13. A pivot hole 26 having a slightly long opening is installed at the center of the cabinet 20. A positioning protruded pin 27 of the extension spring 23 is installed on the cabinet 20 to mesh with the extension spring 23 which in turn forces the pivot rod 21 to move outward towards the opening in cabinet 20, thereby making the color printing roller 22 maintain proper contact with he word roller 16. A journal 28 having a small diameter is respectively provided on each of the two ends of pivot rod 21, and engages with the pivot hole 26 on the roller ends of cabinet 20 respectively after the pivot rod 21 is inserted into the color printing roller 22. Journal 28 also goes through and protrudes some distance over the two ends of cabinet 20, and the extensional force of extension spring 23 drives the journal 28 moving outward along the long pivotal hole 26 to make the color printing roller 22 that is sleeved on the pivot rod 21 properly contact the word roller 16. The color printing roller 22 is made of strong absorbent fibers or fabrics which can absorb a large amount of printing material.

Figure 5:
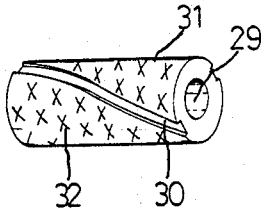
FIGS. 5 and 6 show perspective views of two alternative type of the word roller of the present invention.
Figure 6:
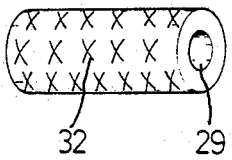

As shown in FIGS. 3, 5 and 6, the aforesaid word roller 16 is made of a proper material suitable for being engraved with bulging words or convex figures. The center of word roller 16 defines a pivotal hole 29 to sleeve and join the pivot rod 15. The rim of word roller 16 can be a unitary surface (as shown in FIG. 6) or have two or more parallel slots 30 which may be the parallel central lines or have proper angle (as shown in FIG. 5) to separate the roller's surface into two or more convex arc portions 31 with set protruding words or FIGS. 32 thereon respectively. Therefore, after the convex arc portions are inked with the printing color, the convex arc portions can print the set words or figures on the back (the glue-containing side) of the blank transparent tape.

Figure 7:
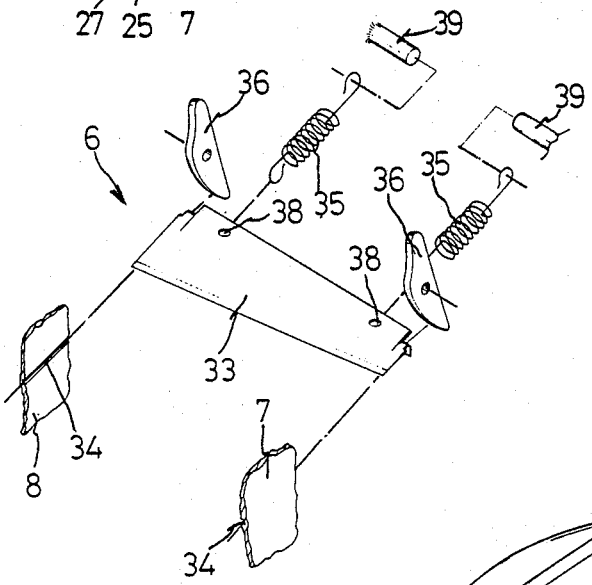
FIG. 7 is an exploded view of the cut-off device of the present invention.

As shown in FIGS. 2 and 7, the cut-off device 6 of the present invention is installed in the slide slot 34 under the rim of the top board 9 and between main roller 3 and the auxiliary roller 4. The cut-off device 6 is composed of the blade 33, slide slot 34, pull-extension spring 35, top block 36 and drive slide board 37. The edge on front rim of the blade 33 is of a oblique form, two holes are provided on a rear end of the blade 33 to firmly hook up the hook of the pull-extension spring 35. The width of the blade 33 is suited to the distance between the side slots 34 on two side boards 7 and 8 and the blade 33 is set therein and moves back and forth. The other end of the spring 35 is hooked on the pin 39 installed on the two side boards 7 and 8 under the drive slide board 37. In this way, the spring 35 performs the function of pulling the blade 33 backward to be stopped by the top block 36. The top block is pivoted in the inner rims between two side boards 7 and 8 and one end of them tops the rear end of the blade 33 and its other end is sleeved in the catch slot 40 installed at two sides of the drive slide board 37. The drive slide boards 37 are sleeved on the bottom of the top board 9 by the slide slot 41 and rivet 42.

Figure 8:
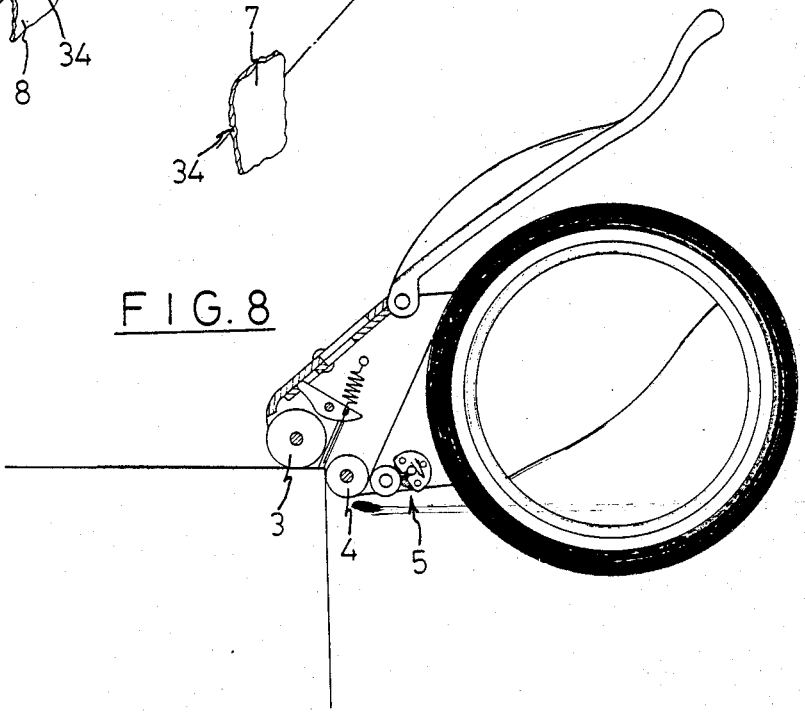
FIG. 8 is a perspective view of the present invention in the use state.

The use and action of the present invention is first to make the suitable transparent blank tape roll 43 be sleeved on the tape sleeve ring 2, and make the tape head 44 be pulled out and through and over the place between the auxiliary roller 4 and word roller device 13. Then, the rear end of the tape head 44 is pasted on the word roller 16 and the tape head 44 extends some amount past the auxiliary roller 4 (as shown in FIG. 2). This is done in preparation of use, before use is completed. While using the device, the user grasps the grip handle 10 of the rear part of the body 1 with his right hand, and makes the main roller 3 face the beginning position of the carton where the user intends to paste. Then, the extended tape head 44 is pressed on the beginning position by the auxiliary roller 4, and the main roller 3 presses tightly against the pasting surface. Tape is pulled out immediately, and the words or figures which are set on the word roller 16 are printed on its back (the glue-containing side) when the tape passes over the word roller 16, the printing tape is immediately and flatly pasted on the rolling surface of the main roller 3. When the user wants the tape to turn 90° to continually paste another side of the carton (as shown in FIG. 8), he may first cause the auxiliary roller 4 turn to another side and then immediately cause the main roller 3 to turn and continue to paste. At the final time to cut off the tape, the user needs only to insert his forefinger into the rectangular hole on the top board 9 to mesh the snap hole 45 on the drive slide board 37 for moving backward. The drive slide board 37 is pushed backward and the catch slots 40 on the two sides of the top board 9 drive the block 36 to push out the blade 33 to cut off the tape. The user's forefinger releases and gets off the snap hole 45, the pull-extension spring 35 contracts to take the blade 33 back, and meanwhile, the rear end of the blade 33 pushes the top block 36 which in turn pushes the drive slide board back to its original position.

What I claim is:

1. A manual carton taping device comprising:

a body having two side boards, a top board and a rear part, the first side board being short and the second side board being long with respect to the first side board, a front part of the top board having an inner rim;

a hollow, cylindrical form tape sleeve ring, said ring being joined to a rear part of the right side board, a semi-circular hole being provided on an upper half part of the right side board covered by the tape sleeve ring;

a cylindrically shaped main roller having an outer diameter;

a cylindrically shaped auxiliary roller pivoted behind the main roller, having an outer diameter smaller than the diameter of the main roller;

a printing device comprising a word roller device and a color printing roller device, pivoted behind the auxiliary roller;

a cut-off device installed in a slide slot under a lower rim of the top board, between the main roller and the auxiliary roller and joined to the inner rim of the top board;

wherein a front part of said body and said first side board both pivot about said main roller, said auxiliary roller and said word printing device and catch and mesh with the blade of the cut-off device, whereby the delivery and use of the tape drives the word printing device automatically so as to print words and figures which are set on a surface of the word roller on a back side of the taper, the tape being pasted immediately on the carton as directed by the user of the device and wherein the auxiliary roller is pivoted at a position between the main roller and the word printing device to aid the main roller in turning 90° to continually paste printed tape on contiguous sides of the carton.

2. The carton-sealing tape sticker and cutter according to claim 1, wherein the word roller device comprises a word roller sleeve on a pivot rod and engaged in a slot hole provided on the two side boards of the body for positioning of the word roller, said cutter further comprises through holes installed one on each of the two side boards adjacent to the word roller device, the color printing roller device being connected to the body by at least three through catch holes installed adjacent to the perimeter of the through holes, said color printing roller device comprising a cabinet, a pivot rod, a color printing roller and an extension spring, wherein said cabinet has an arc shape and has an end wall on each of its two ends respectively, a catch pin which corresponds to the two side boards being provided on an outer rim of each of the end walls respectively, a center of the catch pin being provided with a pivotal hole forming a elongated opening, a positioning convex pin being disposed on each end wall to engage with the extension spring, a journal with a small diameter being provided on each of the two ends of the pivot rod, which extends out a little from the cabinet after the pivot rod is coupled with the color printing roller and engages the pivotal holes of the two ends of the cabinet, the journal being driven to move outward along the elongated pivotal hole by the extension of the extension spring, so that the color printing roller maintains proper contact with the word roller.

3. The carton-sealing tap sticker and cutter according to claim 2, wherein said word roller has a unitary surface.

4. The carton-sealing tape sticker and cutter according to claim 2, wherein said word roller comprises at least two parallel slots which are parallel to the roller or are provided at an angle with respect thereto, to separate a surface of the roller into at least two convex arc portions which have set protruding words or figures thereon.

* * * * *